US012571621B2

(12) United States Patent
Botha et al.

(10) Patent No.: US 12,571,621 B2
(45) Date of Patent: Mar. 10, 2026

(54) DETONATOR ASSEMBLY PLACEMENT

(71) Applicant: DETNET SOUTH AFRICA (PTY) LTD, Johannesburg (ZA)

(72) Inventors: Marius Christo Botha, Johannesburg (ZA); Abraham Johannes Liebenberg, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/713,937

(22) PCT Filed: Sep. 26, 2022

(86) PCT No.: PCT/ZA2022/050047
§ 371 (c)(1),
(2) Date: May 28, 2024

(87) PCT Pub. No.: WO2023/087036
PCT Pub. Date: May 19, 2023

(65) Prior Publication Data

US 2025/0012552 A1 Jan. 9, 2025

(30) Foreign Application Priority Data

Nov. 12, 2021 (ZA) ..... 2021/08971

(51) Int. Cl.
*F42D 1/22* (2006.01)

(52) U.S. Cl.
CPC ..... *F42D 1/22* (2013.01)

(58) Field of Classification Search
CPC ..... F42D 1/22; G01V 1/104
See application file for complete search history.

(56) References Cited

U.S. PATENT DOCUMENTS 1,560,815 A * 11/1925 Hill ..... F42D 1/22 102/319
2,529,763 A * 11/1950 Deputy ..... F42D 1/22 248/316.1
2,704,031 A * 3/1955 Taylor ..... F42D 1/22 24/114.5

(Continued)

FOREIGN PATENT DOCUMENTS

AU 2009203062 A1 2/2011
DE 1277727 B 9/1968
WO 0104563 A1 1/2001

OTHER PUBLICATIONS

International Preliminary Report on Patentability for International Application No. PCT/ZA2022/050047; dated Jun. 30, 2023; 6 pages.

(Continued)

*Primary Examiner* — Benjamin P Lee
(74) *Attorney, Agent, or Firm* — CANTOR COLBURN LLP

(57) ABSTRACT

A device which is used to position a detonator assembly in a borehole. The device has a housing with an open mouth into which one end of the detonator assembly is inserted, formations on the housing which then engage with the detonator assembly, and flexible elements which extend from the housing and which are configured, in use, to engage with a wall of a borehole into which the device and the detonator assembly are inserted.

6 Claims, 6 Drawing Sheets

(56) References Cited

U.S. PATENT DOCUMENTS

Figure 1:
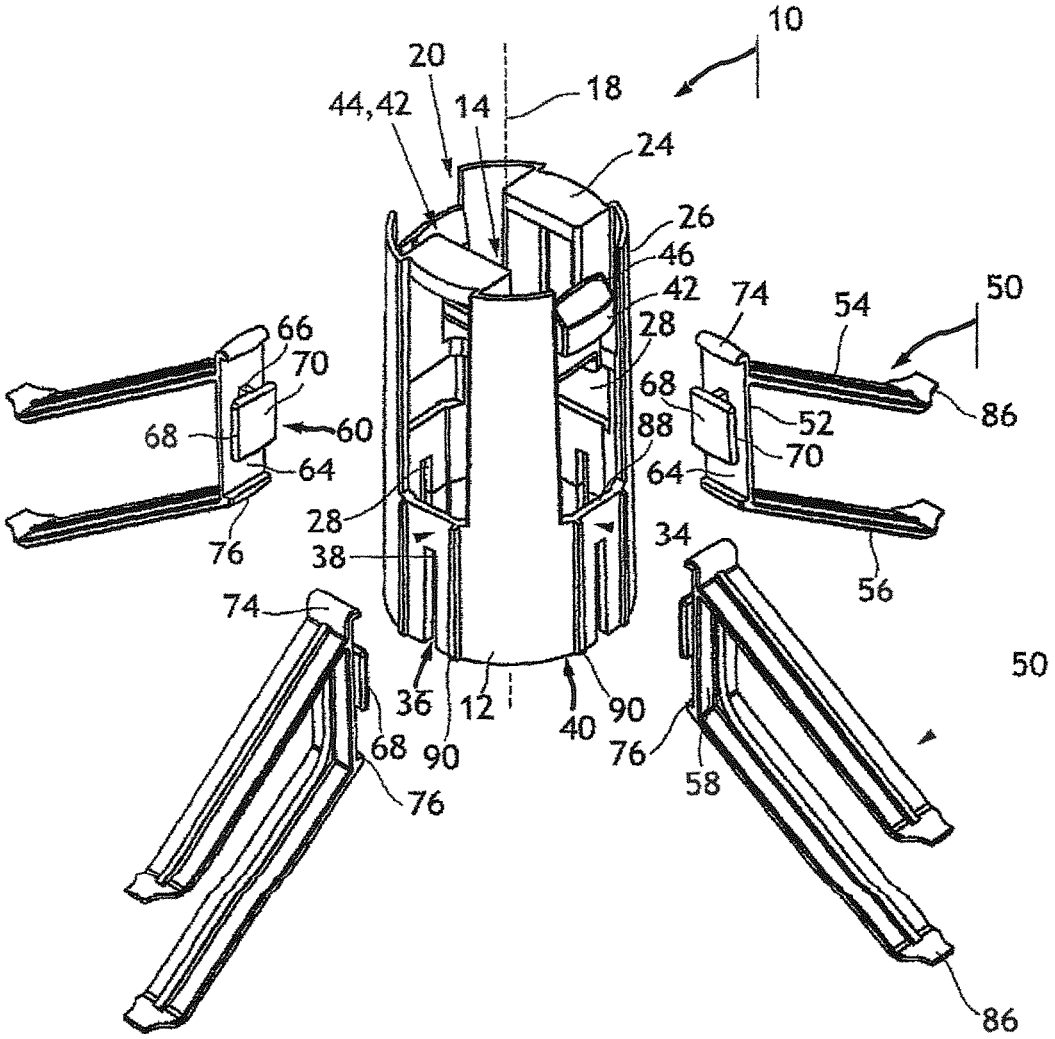

| | | | | | |
|---|---|---|---|---|---|
| 3,280,742 | A * | 10/1966 | Babb | F42D 1/22 | 181/116 |
| 3,342,130 | A * | 9/1967 | Miller | F42D 1/22 | 181/116 |
| 3,939,771 | A * | 2/1976 | McReynolds | F42D 1/22 | 403/361 |
| 4,278,025 | A * | 7/1981 | McReynolds | F42D 1/22 | 285/391 |
| 4,653,710 | A * | 3/1987 | Dickison | A47C 7/004 | 108/150 |
| 4,961,381 | A * | 10/1990 | McLaughlin | F42D 1/22 | 102/319 |
| 6,901,865 | B1 * | 6/2005 | Thomson | F42D 1/22 | 102/319 |
| 2018/0317646 | A1 * | 11/2018 | Rassat | A47B 13/023 | |

OTHER PUBLICATIONS

International Search Report for International Application No. PCT/ZA2022/050047; dated Jan. 19, 2023; 4 pages.
Written Opinion for International Application No. PCT/ZA2022/050047; dated Jan. 19, 2023; 5 pages.

* cited by examiner

DETONATOR ASSEMBLY PLACEMENT

CROSS-REFERENCE TO RELATED APPLICATIONS

This application is a U.S. national stage application of International Application No. PCT/ZA2022/050047 entitled "DETONATOR ASSEMBLY PLACEMENT", which has an international filing date of 26 Sep. 2022, and which claims priority to South African Patent Application No. 2021/08971, filed 12 Nov. 2021.

BACKGROUND OF THE INVENTION

This invention relates generally to a detonator assembly and, more particularly, to the placement or positioning of the detonator assembly in a borehole. WO 01/04563 discloses a primer casing comprising a sleeve portion and a leading portion, wherein the sleeve portion is adapted to receive a primer and comprises a blasthole engagement means. U.S. Pat. No. 3,939,771 discloses a seismic explosive charge loader which comprises two tubular members. The first tubular member is configured to receive a loading pole and the second tubular member is configured to receive an explosive charge container. A nose cap is provided at the bottom portion of the explosive container. The nose cap protects the bottom of the explosive container, keeps the blasting cap in place and guides the container downwardly in the borehole. The charge loader is provided with one or more transversely extending openings to receive anchor members.

WO 01/04563 discloses a primer casing comprising a sleeve portion and a leading portion, wherein the sleeve portion is adapted to receive a primer and comprises a blasthole engagement means.

U.S. Pat. No. 3,939,771 discloses a seismic explosive charge loader which comprises two tubular members. The first tubular member is configured to receive a loading pole and the second tubular member is configured to receive an explosive charge container. A nose cap is provided at the bottom portion of the explosive container. The nose cap protects the bottom of the explosive container, keeps the blasting cap in place and guides the container downwardly in the borehole. The charge loader is provided with one or more transversely extending openings to receive anchor members.

A detonator assembly which includes an electronically configured detonator which is responsive to a radio signal received by a communication module which interacts, for example, with a booster, can be a fairly bulky component. The assembly must be shaped to be inserted into a borehole and, as the diameter of the borehole is determined due to external considerations there, inherently, is a limitation on the transverse dimensions of the detonator assembly and, consequently, the detonator assembly may have a substantial length between its opposed ends.

When a detonator assembly of the aforementioned kind is placed into a borehole it must be correctly positioned and, moreover, must be able to withstand forces exerted by an explosive material which is being charged into the borehole. In that regard the explosive material should be able to bypass the detonator assembly which, in turn, should remain securely at a predetermined position.

The aforementioned considerations apply when the detonator assembly is inserted, downwardly, into a borehole or, horizontally or upwardly, into boreholes of different inclinations.

An object of the present invention is to address the aforementioned situation.

SUMMARY OF THE INVENTION

The invention provides a device for use in positioning a detonator assembly in a borehole wherein the detonator assembly includes an elongate body with a first end and an opposed second end, the device comprising a housing, a volume, inside the housing with a central axis, a mouth on the housing through which the first end of the body is insertable into the volume, at least one formation on the housing configured to engage with the body thereby to retain the first end inside the volume, and at least one retention member which includes a base which is engageable with the housing and at least one elongate flexible element which extends from the base radially outwardly relative to the base and at an acute angle relative to the central axis.

The housing may include a wall with a plurality of apertures.

An outer surface of the wall may include a number of recessed formations.

A respective elongate slot may be formed through a floor of each recessed formation.

The slot may be parallel to the central axis.

Each recessed formation may be elongate and may extend on an outer wall surface in a longitudinal direction i.e generally parallel to the central axis of the volume.

The base of the retention member may include a rib, and at least one flange which extends transversely relative to the rib.

The rib and flange may be engageable with a sliding action with a recessed formation. Preferably the rib extends through the slot and the flange abuts a rear surface of the floor of the recessed formation.

The retention member preferably includes two or more of the elongate flexible elements. These elements may be spaced from one another in the aforementioned longitudinal direction.

The base of the retention member may include a stop formation which limits the degree of sliding movement of the retention member relative to the recessed formation.

The formation on the housing which is engageable with the body of the detonator assembly may have a degree of flexibility. The formation on the housing may be configured to engage with a formation, on the body, which is of complementary shape to the formation thereby to ensure that the device is firmly and securely coupled to the body of the detonator assembly.

In one form of the invention an end of the housing which is remote from the mouth is shaped to have a tapered leading end to facilitate insertion of the device, and a detonator assembly to which the device is attached, into a borehole.

The invention also extends to a detonator assembly which includes an elongate body with a first end and a second end, a first device of the aforementioned kind engaged with the first end of the body and a second device of the aforementioned kind, but including a tapered leading end, engaged with a second end of the body.

BRIEF DESCRIPTIONS OF THE DRAWINGS

Figure 2:
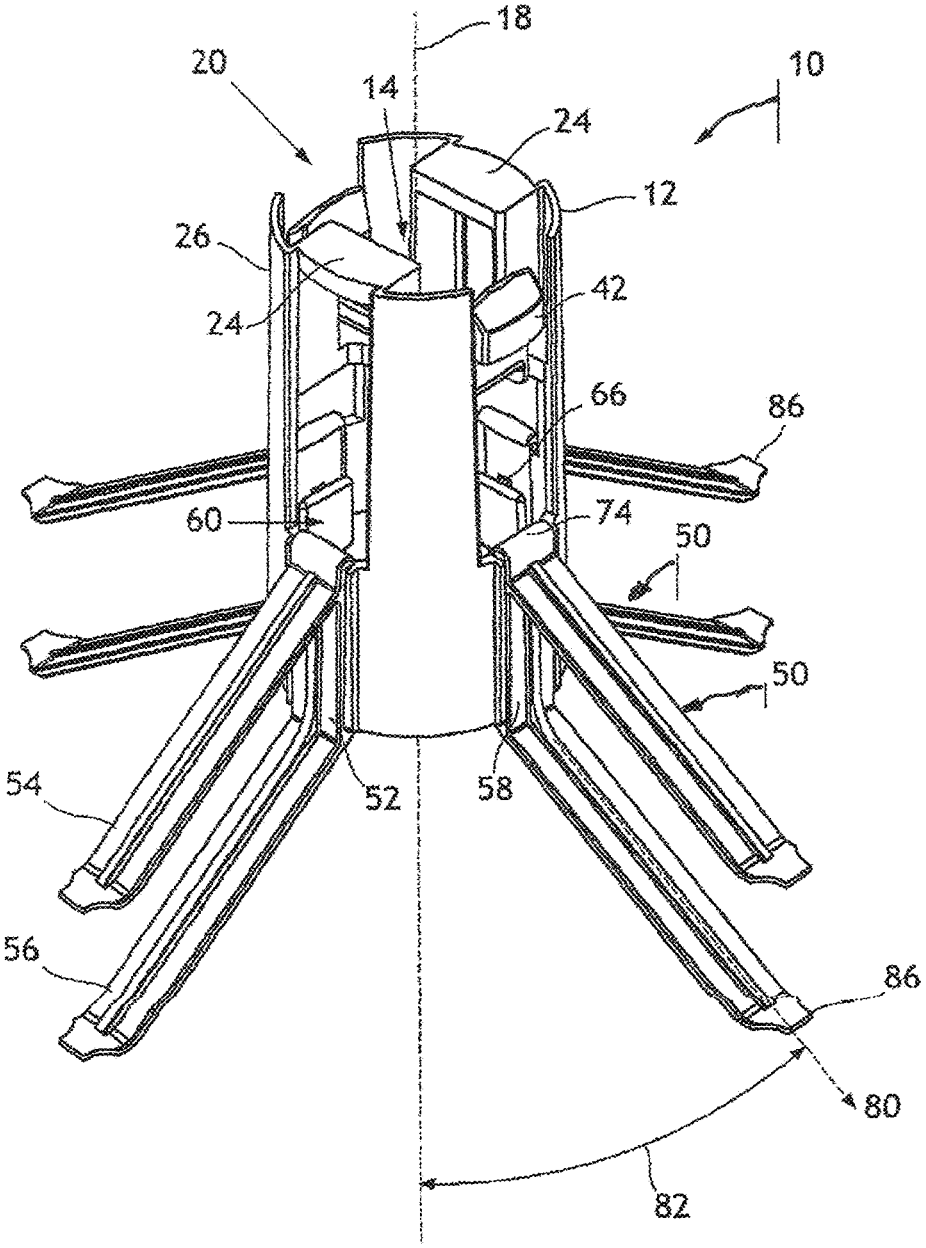
Figure 3:
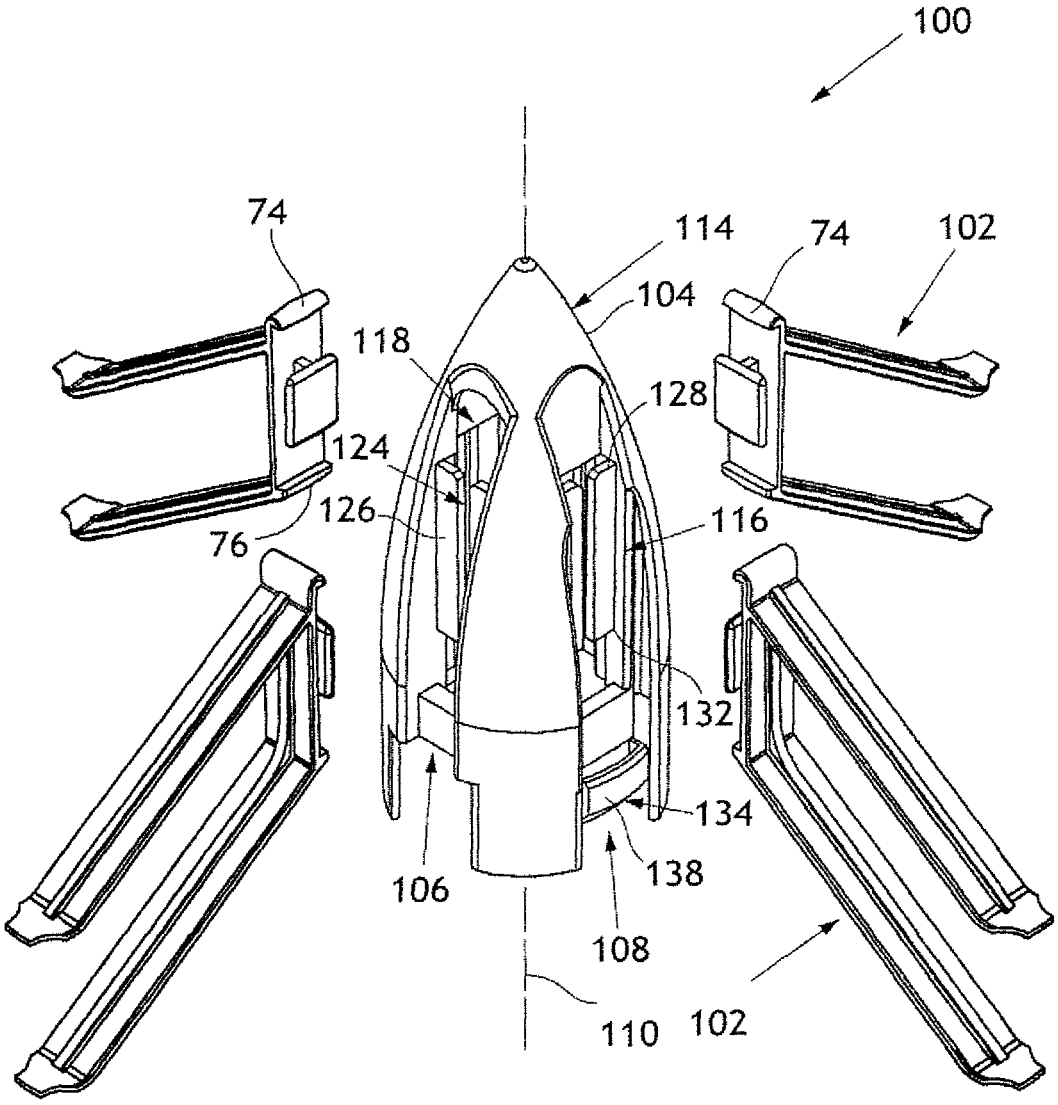
Figure 4:
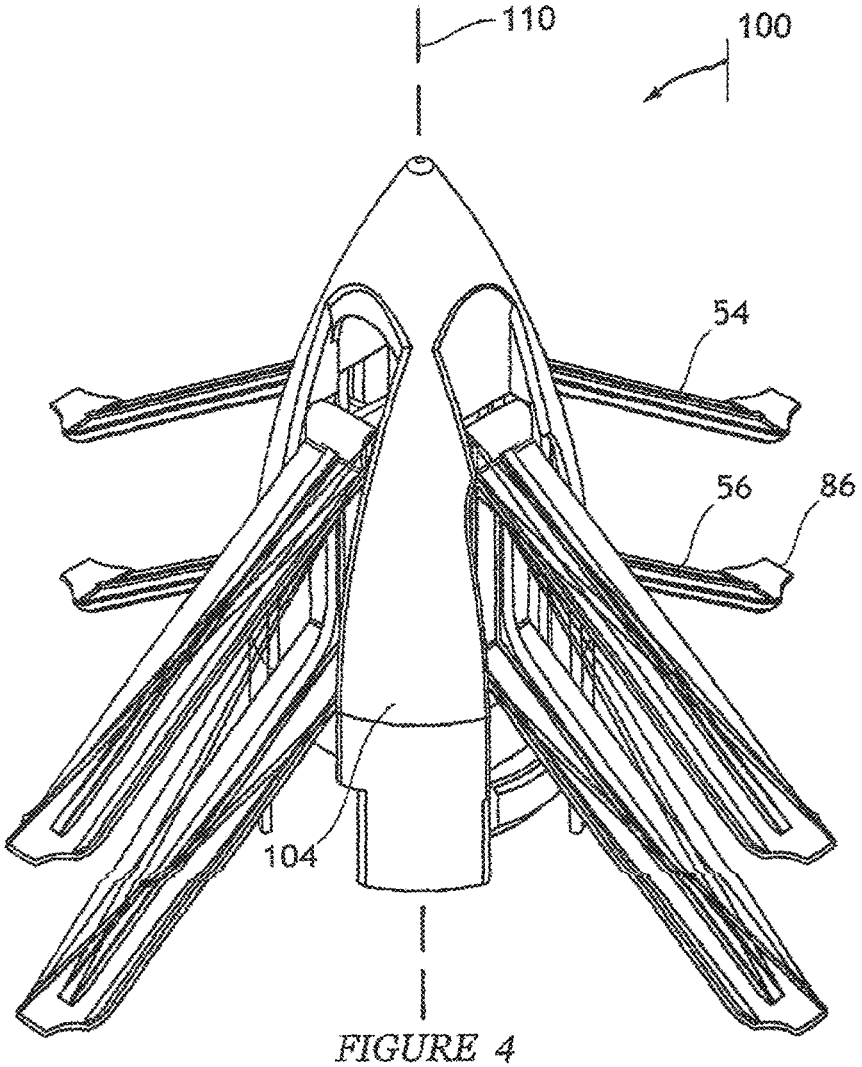
Figure 5:
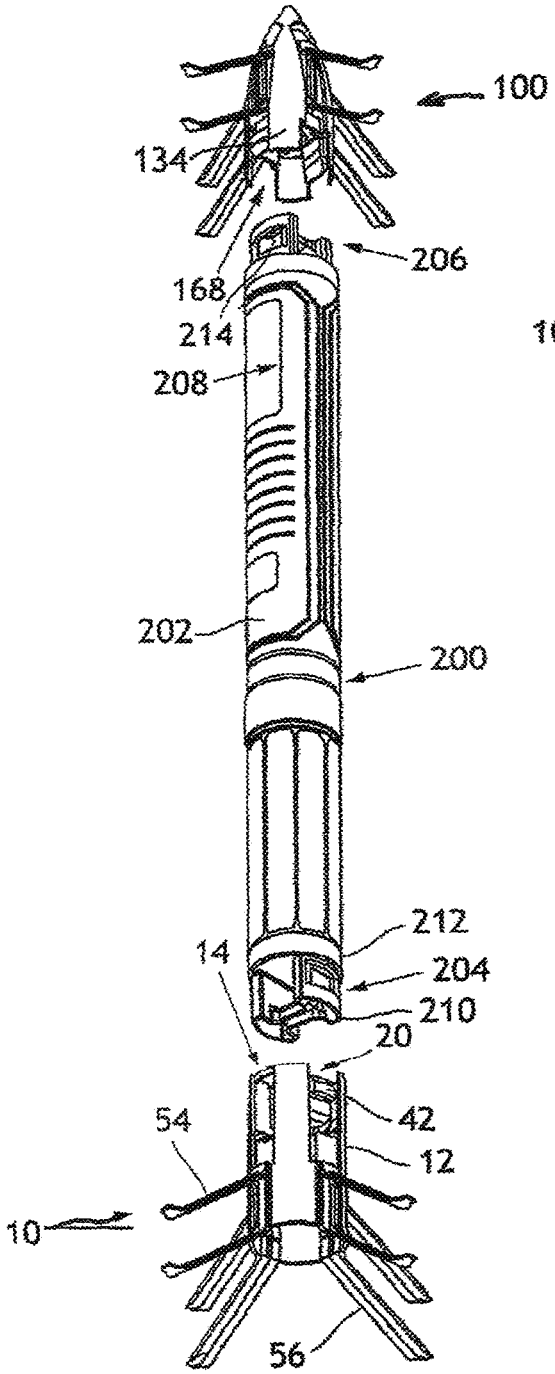
Figure 6:
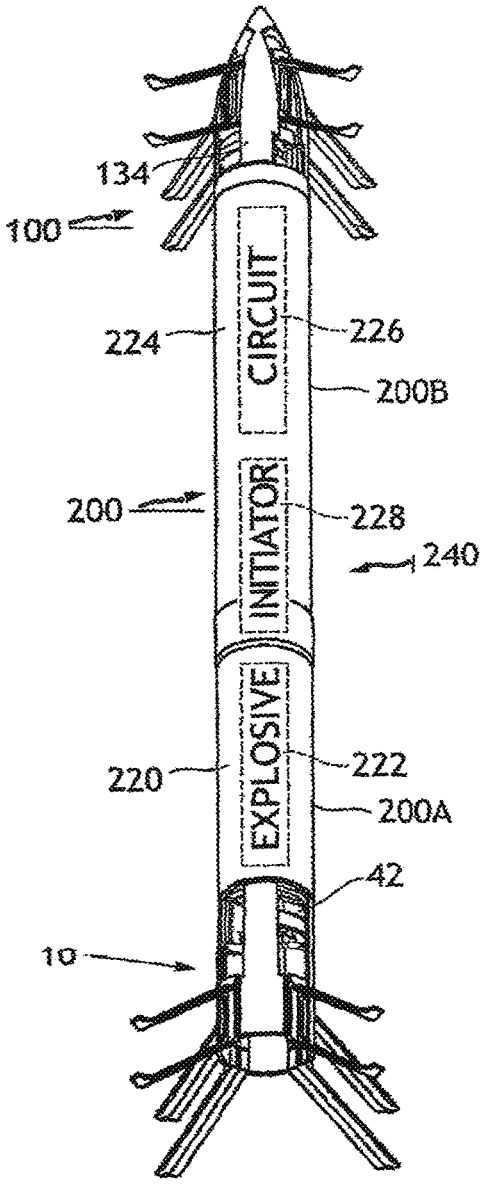
Figure 7:
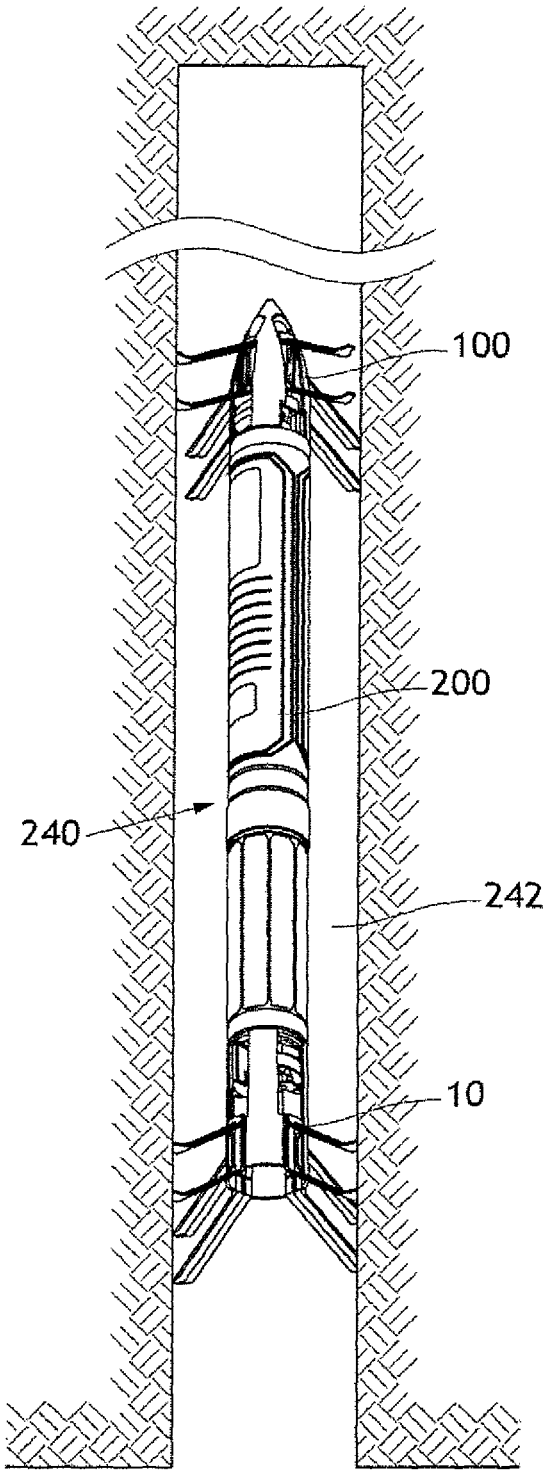

The invention is further described by way of example with reference to the accompany drawings in which:

FIG. 1 illustrates a device according to a first form of the invention in an exploded configuration, FIG. 2 shows the device of FIG. 1 assembled, FIG. 3 illustrates a device according to a second form of the invention in an exploded configuration, FIG. 4 shows the device of FIG. 3 assembled, FIG. 5 shows a device according to FIG. 2 and a device according to FIG. 4 displaced from a detonator assembly, FIG. 6 shows the components in FIG. 5 in an assembled configuration, and FIG. 7 illustrates the assembly of FIG. 6 installed in a borehole.

DESCRIPTION OF PREFERRED EMBODIMENTS

FIGS. 1 and 2 are exploded and assembled views respectively of a device 10 according to one form of the invention.

The device 10 includes a housing 12 which encloses a volume 14. The volume has a central axis 18.

At one end the housing has a mouth 20 which opens into the volume 14. Opposed fixing formations 24 extend inwardly from a wall 26 of the housing adjacent the mouth 20.

The wall 26 is formed with four rectangular apertures 28 which are evenly spaced from one another in a circumferential sense extending around the central axis 18. At a lower end of each aperture 28 (in the drawings) the wall 26 is formed with a longitudinally extending recessed formation 34. Each recessed formation 34 includes an elongate slot 36 which is formed through a floor 38 of the recessed formation extending parallel to the central axis 18 from an end 40 of the housing in a direction towards the mouth 20.

Opposed locking clips 42 and 44, at the mouth 20, have sloping outer surfaces 46.

The device 10 includes four retention members 50 which are identical to one another. Each retention member includes a base 52 and two spaced apart flexible elements 54 and 56 which extend from an outer surface 58 of the base and which are spaced apart from each other in the direction of the central axis 18. A locking member 60 of generally rectangular format is positioned on an inner surface 64 of the base. The locking member 60 includes a central longitudinally extending rib 66 and opposed flanges 68 and 70 which project transversely to the rib and which are spaced from the inner surface 64 of the base 52.

The base 52, at one end, has a locking member in the form of a first flange 74 which extends from the inner surface 64 in the same direction as the rib 66, and a stop member in the form of a second flange 76 which is similar to the first flange 74 but which is located at an opposed end of the base.

The elements 54 and 56, although flexible, are robust. As is apparent from FIG. 2 each element, in a longitudinal direction 80, subtends an acute angle 82 with respect to the central axis 18 (when the retention member is engaged with the housing). Each flexible element 54, 56, at an end which is remote from the base 52, has a respective bent end section 86 which provides a gripping function when the device is inserted into a borehole.

Each retention member 50 is engageable with a sliding action with a respective recessed formation 34. The first flange 74 is positioned in the recessed formation and the retention member 50 is then urged towards the mouth 20. The rib 66 enters the mouth of the slot 36 and the flanges 68 and 70 are thereby engaged with a rear surface of the floor 38 of the recessed formation 34, which surface faces inwardly towards the central axis 18. The first flange 74 is slightly flexible and, once this flange reaches an edge 88 of the recessed formation 34, adjacent the corresponding aperture 28, the first flange 74 clips into position with the edge 88. Simultaneously, the second flange 76, at the trailing end of the base, abuts an opposed edge 90 of the recessed formation 34 at a lower end of the housing (in FIGS. 1 and 2).

The four retention members 50 are engaged in a similar manner with the housing 12 to provide the assembled device 10 as shown in FIG. 2.

FIGS. 3 and 4 illustrate a device 100 according to another form of the invention. The device 100 is similar in many respects to the device 10.

The device 100 includes four retention members 102 which are identical to the members 50.

The device 100 has a housing 104 which encloses a volume 106. A mouth 108 at a lower end of the housing (in FIG. 3) provides access to the volume 106 which has a central axis 110.

The housing 104 at an end which is remote from the mouth 108 has a leading end 114 which has a tapered and conical shape.

The housing 104 has recessed formations 116 which are circumferentially displaced from one another around the central axis 110, in a similar manner to the way in which the recessed formations 34 are displaced from each other on the device 10. At an upper end (in FIG. 3) each recessed formation 116 is adjacent a respective aperture 118. A respective slot 124 in a floor 126 of each recessed formation 116 extends, parallel to the central axis 110, from an upper edge 128 (in FIG. 3) centrally through the floor in a direction towards a lower edge 132.

The housing 104 includes opposed locking clips 134 and 136, at the mouth 108, which have sloping outer surfaces 138. The clip 136 is not visible in FIG. 3 but it is identical to the clip 134 but on an opposed side of the housing.

The retention members 102 are engageable with the housing 104 in a manner which is similar to that described in connection with the device 10 in FIGS. 1 and 2. FIG. 4 illustrates the fully assembled device 100.

FIG. 5 shows a detonator assembly 200 which comprises an elongate body 202 with a first end 204, an opposed second end 206, and an outer surface 208. The detonator assembly 200 is located between a device 10 (FIGS. 1 and 2) and a device 100 (FIGS. 3 and 4). In FIG. 6 the devices 10 and 100 are depicted engaged with the detonator assembly 200. The end 204 is configured to be inserted into the mouth 20 of the device 10. The fixing formations 24 flex slightly to allow this movement and a part of the end 204, which has a complementary shape to the mouth 20, can then be positioned inside the volume 14. As the end 204 engages with the mouth 20 of the device 10 the locking clips 42 and 44 flex slightly, with the sloping surfaces 46 sliding over corresponding surfaces of locking formations 210 at the end 204, until engagement of the clips with respective apertures 212 at the end 204 takes place.

Similarly, the device 100 is engageable with a part of the second end 206 which is inserted through the mouth 108 into the volume 106. Locking formations similar to the formations 24, shown in FIG. 1, flex slightly to allow for this insertion. The end 206 has a complementary shape to the mouth 108. The locking clips 134 and 136 of the device 100 are guided by the sloping outer surfaces 138 into locking engagement with respective apertures 214 at the end 206 of the detonator assembly 200.

The detonator assembly 200 typically comprises a first section 200A which consists of a tubular housing 220 with an internal explosive charge 222, a second section 200B with consists of a tubular housing 224 in which are mounted an antenna, a receiver and processing circuitry 226, and an initiator 228 which is ignited upon receipt of a fire command by the circuitry 226 and which then initiates the explosive charge 222. These components are shown in dotted outline only.

The fully assembled arrangement 240 comprising the device 10, the device 100, and the detonator assembly 200 positioned between the two devices, can be inserted into a borehole 242 as is shown in FIG. 7. The arrangement is pushed along inside the borehole to a predetermined position. During this movement the bent end sections 86 of the various elongate flexible elements 54 and 56 can deform but are urged, continuously, into frictional engagement with the wall of the borehole due to the natural resilience of the material from which the elements are made. Once the arrangement 240 reaches a desired position in the borehole then frictional forces, exerted by the bent end sections 86, ensure that the arrangement 240 remains in that position.

The retention members 50 are circumferentially displaced from one another around the respective housing. Openings are formed, in a circumferential sense, between adjacent pairs of the retention members which allow ample space for passage of an explosive material which may then be charged into the borehole. The retention members 50, which project outwardly from the housing, increase the "diameter" of the device (10 or 100). However as the retention members are normally only engaged with the respective housing on site, when the device is coupled to a detonator assembly, the components of the device, i.e. the housing and the retention members, prior to assembly, occupy a volume which is reduced in size compared to the volume occupied by the assembled device.

The invention claimed is:

1. A device for positioning a detonator assembly in a borehole wherein the detonator assembly includes an elongate body with a first end and an opposed second end, the device comprising a housing, a volume inside the housing with a central axis, a mouth on the housing through which the first end of the body is insertable into the volume, at least one formation on the housing configured to engage with the first end of the body thereby to retain the first end inside the volume and leave a portion of the body including the second end outside the volume, wherein the housing includes a wall with a plurality of apertures which are evenly spaced from one another in a circumferential sense extending around the central axis and wherein at a lower end of each aperture the wall includes a number of recessed formations and a plurality of retention members, each of which includes a respective base which is engageable with a respective one of the recessed formations on the housing, and at least one elongate flexible element which extends from each respective base radially outwardly relative to each base and at an acute angle relative to the central axis.

2. A device according to claim 1 wherein a respective slot which is parallel to the central axis is formed through a floor of each recessed formation.

3. A device according to claim 2 wherein the respective base of each retention member includes a rib which extends through the slot and at least one flange which abuts a rear surface of the floor of the recessed formation.

4. A device according to claim 1 wherein each retention member includes at least two of the elongate flexible elements which are spaced from one another in a direction which is parallel to the central axis.

5. A device according to claim 1 wherein an end of the housing which is remote from the mouth is shaped to have a tapered leading end to facilitate insertion of the device and a detonator assembly to which the device is attached, into a borehole.

6. An assembly comprising a detonator assembly which has an elongate body with a first end and an opposed second end, a device according to claim 1 which: (a) is engaged with the first end of the body, and (b) wherein an end of the housing which is remote from the mouth is shaped to have a tapered leading end to facilitate insertion of the assembly into a borehole, and which is engaged with the second end of the body.

* * * * *